US008535175B2

(12) United States Patent
Kato

(10) Patent No.: US 8,535,175 B2
(45) Date of Patent: Sep. 17, 2013

(54) GOLF CLUB SHAFT AND GOLF CLUB

(75) Inventor: Masatoshi Kato, Kobe (JP)

(73) Assignee: SRI Sports Limited, Kobe (JP)

( * ) Notice: Subject to any disclaimer, the term of this patent is extended or adjusted under 35 U.S.C. 154(b) by 544 days.

(21) Appl. No.: 12/790,571

(22) Filed: May 28, 2010

(65) Prior Publication Data

US 2010/0317456 A1 Dec. 16, 2010

(30) Foreign Application Priority Data

Jun. 12, 2009 (JP) ..... 2009-140638

(51) Int. Cl.
*A63B 53/10* (2006.01)

(52) U.S. Cl.
USPC ..... 473/319

(58) Field of Classification Search
USPC ..... 473/316–323
See application file for complete search history.

(56) References Cited

U.S. PATENT DOCUMENTS

| | | | | | |
|---|---|---|---|---|---|
| 4,517,321 | A * | 5/1985 | Gardner et al. | 523/400 |
| 5,088,735 | A * | 2/1992 | Shigetoh | 473/320 |
| 5,156,396 | A * | 10/1992 | Akatsuka et al. | 473/319 |
| 5,188,872 | A * | 2/1993 | Quigley | 428/36.2 |
| 5,326,099 | A * | 7/1994 | Yamamoto et al. | 473/315 |
| 5,385,767 | A * | 1/1995 | Noguchi | 428/36.91 |
| 5,665,441 | A * | 9/1997 | Suzue et al. | 428/34.7 |
| 5,721,030 | A | 2/1998 | Okada | |
| 5,968,621 | A * | 10/1999 | Okada | 428/36.3 |
| 6,270,426 | B1 | 8/2001 | Matsumoto | |
| 6,273,830 | B1 * | 8/2001 | Takemura et al. | 473/319 |
| 6,514,156 | B1 * | 2/2003 | Zorzi | 473/319 |
| 6,709,347 | B1 * | 3/2004 | Ono et al. | 473/319 |
| 7,468,005 | B2 * | 12/2008 | Kouno et al. | 473/347 |
| 8,206,238 | B2 * | 6/2012 | Kaneko et al. | 473/320 |
| 8,376,875 | B2 * | 2/2013 | Nakamura et al. | 473/319 |
| 2005/0009621 | A1 | 1/2005 | Matsumoto et al. | |
| 2007/0072697 | A1 | 3/2007 | Matsumoto et al. | |

(Continued)

FOREIGN PATENT DOCUMENTS

| | | | |
|---|---|---|---|
| JP | 61-121933 | A | 6/1986 |
| JP | 0524235 | * | 9/1993 |

(Continued)

OTHER PUBLICATIONS

'Toray' Torayca product material list, PD-YN4, Nov. 2001, 2 pp., http://www.kaizenken.jp/db/chap2/data2_2/1_high-strength_and_high-modulus_fiber/2_2_1_1_torayca.pdf.

*Primary Examiner* — Stephen L. Blau
(74) *Attorney, Agent, or Firm* — Birch, Stewart, Kolasch & Birch, LLP

(57) ABSTRACT

A shaft 6 includes a textile layer. The textile layer has a biaxial textile 20 composed of warps and wefts. The warp is oriented substantially parallel to an axial direction of the shaft. The weft is oriented substantially perpendicularly to the axial direction of the shaft. When a tensile elastic modulus of the warp is defined as ET (tf/mm$^2$) and a tensile elastic modulus of the weft is defined as EY (tf/mm$^2$), the tensile elastic modulus ET is smaller than the tensile elastic modulus EY. Preferably, the warp is a PAN carbon fiber and the weft is a pitch carbon fiber. Preferably, when a tensile strength of the warp is defined as ST (kgf/mm$^2$) and a tensile strength of the weft is defined as SY (kgf/mm$^2$), the tensile strength ST is greater than the tensile strength SY.

12 Claims, 7 Drawing Sheets

(56) References Cited

U.S. PATENT DOCUMENTS

| | | | |
|---|---|---|---|
| 2008/0070716 | A1 | 3/2008 | Kumamoto |
| 2008/0311326 | A1 | 12/2008 | Fujimoto |
| 2009/0305811 | A1 | 12/2009 | Matsumoto et al. |

FOREIGN PATENT DOCUMENTS

| | | | | |
|---|---|---|---|---|
| JP | 05245235 | A | * | 9/1993 |
| JP | 7-68651 | A | | 3/1995 |
| JP | 07196823 | A | * | 8/1995 |
| JP | 8-131588 | A | | 5/1996 |
| JP | 11206931 | A | * | 8/1999 |
| JP | 2000245880 | A | * | 9/2000 |
| JP | 2000-288139 | A | | 10/2000 |
| JP | 2004-121402 | A | | 4/2004 |
| JP | 2006-61473 | A | | 3/2006 |
| JP | 2007-000429 | | * | 11/2007 |
| JP | 2008-148757 | A | | 7/2008 |

* cited by examiner

GOLF CLUB SHAFT AND GOLF CLUB

This application claims priority on Patent Application No. 2009-140638 filed in JAPAN on Jun. 12, 2009, the entire contents of which are hereby incorporated by reference.

BACKGROUND OF THE INVENTION

1. Field of the Invention

The present invention relates to a golf club shaft and a golf club having the shaft.

2. Description of the Related Art

A golf club shaft having a carbon fiber has been commercially available. The shaft is also referred to as a carbon shaft. A carbon shaft having a light weight and a high strength can be manufactured by using the carbon fiber.

As a method for manufacturing the carbon shaft, a sheet winding process and a filament winding process have been known. Of these, the sheet winding process can produce shafts having different characteristics according to the disposal of prepreg sheets, the orientation of the carbon fiber and the type of the carbon fiber, or the like. The sheet winding process has a high degree of freedom in design.

Japanese Patent Application Laid-Open No. 2008-148757 (US2008/070716) discloses a shaft having a textile layer having warps and wefts. The textile layer has an axial fiber and a circumferential fiber. One of the warp and the weft is defined as the axial fiber, and the other is defined as the circumferential fiber.

Japanese Patent Application Laid-Open No. 2004-329738 (US2005/009621, US2007/072697 and US2009/305811) discloses a shaft having a plain weave textile layer. The warps and wefts of the textile layer are oriented obliquely to the longitudinal direction of the shaft.

Japanese Patent Application Laid-Open No. 2006-61473 discloses a shaft having a plain weave textile layer and a triaxial textile layer. The warps and wefts of the plain weave textile layer are oriented obliquely to the longitudinal direction of the shaft. The triaxial textile layer has wefts, first warps and second warps. The wefts of the triaxial textile layer are oriented parallel or perpendicularly to the longitudinal direction of the shaft.

Japanese Patent Application Laid-Open No. 2000-14843 (U.S. Pat. No. 6,270,426) discloses a shaft having a triaxial textile layer. The publication discloses the shaft in which the physical properties or the like of a fiber constituting the triaxial textile layer vary in the longitudinal direction of the shaft. The publication discloses the shaft having different triaxial textile layers located at positions (for example, a tip side, an intermediate portion and a butt side of the shaft) of the longitudinal direction of the shaft.

Japanese Patent Application Laid-Open No. 2000-288139 discloses a shaft which has a two-axis braided layer provided as an outermost layer and a three-axis braided layer provided on the inner side of the two-axis braided layer.

Japanese Patent Application Laid-Open No. 2008-307701 (US2008/311326) and Japanese Patent Application Laid-Open No. 8-131588 disclose a shaft having a straight layer and a hoop layer.

SUMMARY OF THE INVENTION

In the present application, a shaft capable of having a light weight and a high strength has been invented based on new technical thoughts.

It is an object of the present invention to provide a shaft capable of having a light weight and a high strength.

A golf club shaft of the present invention includes a textile layer. The textile layer has a biaxial textile including warps of a carbon fiber and wefts of a carbon fiber. The warp is oriented substantially parallel to an axial direction of the shaft. The weft is oriented substantially perpendicularly to the axial direction of the shaft. When a tensile elastic modulus of the warp is defined as ET (tf/mm$^2$) and a tensile elastic modulus of the weft is defined as EY (tf/mm$^2$), the tensile elastic modulus ET is smaller than the tensile elastic modulus EY.

Preferably, the warp is a PAN carbon fiber and the weft is a pitch carbon fiber.

Preferably, when a tensile strength of the warp is defined as ST (kgf/mm$^2$) and a tensile strength of the weft is defined as SY (kgf/mm$^2$), the tensile strength ST is greater than the tensile strength SY.

Another golf club shaft of the present invention includes at least one textile layer. The textile layer has a biaxial textile including warps of a carbon fiber and wefts of a carbon fiber. The warp is oriented substantially parallel to an axial direction of a shaft. The weft is oriented substantially perpendicularly to the axial direction of the shaft. The warp is a PAN carbon fiber and the weft is a pitch carbon fiber.

Still another golf club shaft of the present invention includes at least one textile layer. The textile layer has a biaxial textile including warps of a carbon fiber and wefts of a carbon fiber. The warp is oriented substantially parallel to an axial direction of the shaft. The weft is oriented substantially perpendicularly to the axial direction of the shaft. When a tensile strength of the warp is defined as ST (kgf/mm$^2$) and a tensile strength of the weft is defined as SY (kgf/mm$^2$), the tensile strength ST is greater than the tensile strength SY.

A golf club of the present invention includes any one of the shafts, a head, and a grip.

A shaft having a light weight and a high strength can be obtained by making the carbon fiber of the warp different from that of the weft and appropriately setting the characteristics of the warp and the weft.

DESCRIPTION OF THE PREFERRED EMBODIMENTS

The present invention will be described below in detail based on preferred embodiments with reference to the drawings.

Figure 1:
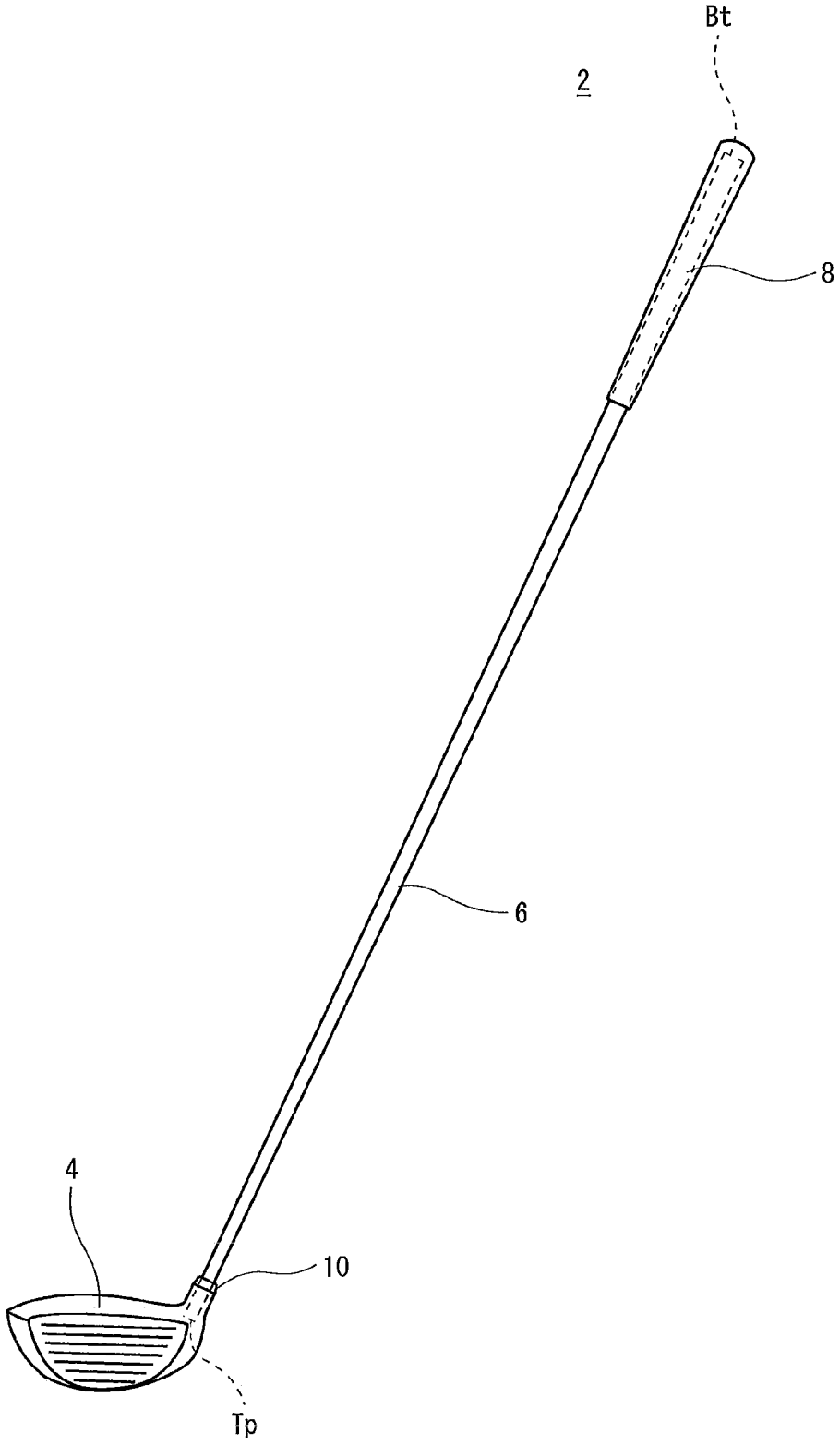
FIG. 1 is an overall view of a golf club according to one embodiment of the present invention.

As shown in FIG. 1, a golf club 2 is provided with a head 4, a shaft 6 and a grip 8. The golf club 2 is further provided with a ferrule 10. The head 4 is a wood type golf club head. The head 4 is provided at the tip part of the shaft 6. The grip 8 is provided at the rear end part of the shaft 6. The head 4 has a hollow structure which is not shown. The head 4 is made of, for example, a titanium alloy. The head 4 and the grip 8 are not limited. As the head 4, the wood type head, a utility type head, a hybrid type head, an iron type head and a putter head are exemplified.

The shaft 6 includes a laminate of fiber reinforced resin layers. The shaft 6 is a tubular body. The shaft 6 has a hollow structure which is not shown. As shown in FIG. 1, the shaft 6 has a front edge (tip) Tp and a rear end (butt) Bt. The tip Tp is located inside the head 4. The rear end Bt is located inside the grip 8.

The shaft 6 is a so-called carbon shaft. Preferably, the shaft 6 is produced by curing a prepreg sheet. This prepreg sheet has a fiber and a matrix resin. Typically, this fiber is a carbon fiber. Typically, this matrix resin is a thermosetting resin.

Preferably, the shaft 6 is manufactured by a so-called sheet winding process. In the prepreg, the matrix resin is in a semicured state. The shaft 6 is manufactured by winding and curing the prepreg sheet. This curing means the curing of the semicured matrix resin. This curing is attained by heating. The manufacturing process of the shaft 6 includes a heating process. This heating process cures the matrix resin of the prepreg sheet.

The shaft 6 can be also manufactured without using the prepreg sheet. A filament winding process is exemplified as another manufacturing process of the shaft 6. However, at least a textile layer to be described later is preferably made of the prepreg sheet.

When the sheet winding process is employed, the number of the sheets is not limited. The arrangement of each of the sheets, the shape of each of the sheets, and the fiber used in each of the sheets, or the like are not limited. Except for the textile sheet, the orientation angle or the like of the fiber in each of the sheets is not limited.

Figure 3:
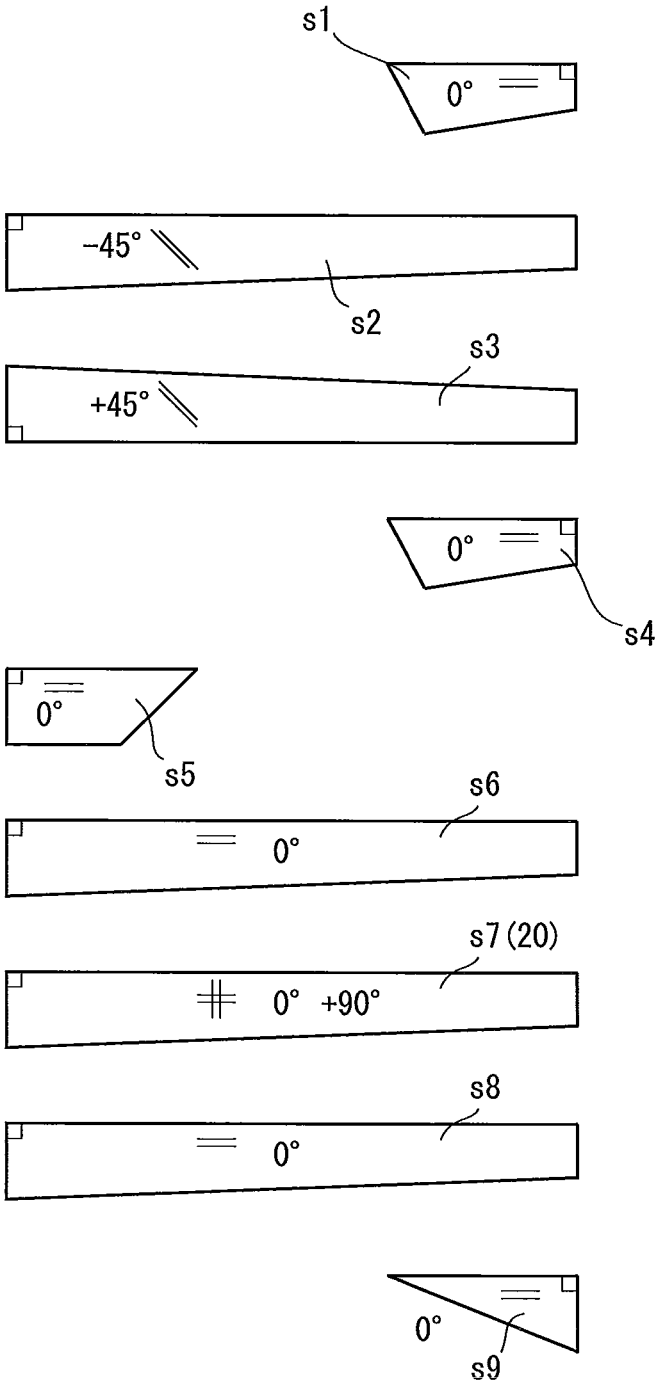
FIG. 3 is a development view of the shaft of FIG. 2.

FIG. 3 is a development view (sheet constitution view) of the prepreg sheets constituting the shaft 6 according to one embodiment of the present invention. The shaft 6 includes a plurality of sheet. Specifically, the shaft 6 includes nine sheets s1 to s9. In the present application, the development view shown in FIG. 3 or the like shows the sheets constituting the shaft in order from the radial inner side of the shaft. The sheets are wound around a mandrel in order from the sheet located above in the development view. In the development view of FIG. 3 or the like, the horizontal direction of the figure agrees with the axial direction of the shaft. In the development view of FIG. 3 or the like, the right side of the figure is the tip Tp side of the shaft. In the development view of FIG. 3 or the like, the left side of the figure is the butt Bt side of the shaft.

The development view of FIG. 3 or the like shows not only the winding order of each of the sheets but also the arrangement of each of the sheets in the axial direction of the shaft. For example, one end of the sheet s1 is located at the tip Tp. For example, the other end of the sheet s5 is located at the butt Bt.

The shaft 6 has a straight layer and a bias layer. The orientation angle of a fiber is described in the development view of FIG. 3 or the like. A sheet described as "0 degree" constitutes the straight layer. The sheet for the straight layer is also referred to as a straight sheet in the present application. Sheets described as "−45 degrees" and "+45 degrees" constitute the bias layer. The bias layer is also referred to as an oblique layer. The sheet for the bias layer is also referred to as a bias sheet in the present application.

A straight layer is a layer in which the orientation direction of a fiber is substantially made parallel to the axial direction of the shaft. Usually, the orientation of the fiber to the axial direction of the shaft is incompletely parallel because of error or the like in winding. In consideration of this point, the error of ±10 degrees is permitted for the orientation angle of the fiber to the axial line of the shaft in the present application. This permissible error is also applied to the orientation angles of warp and weft to be described later.

The prepreg s1 is a layer which reinforces a tip part. In the prepreg s1, the orientation angle of a fiber is substantially parallel to the axial line of the shaft. "Substantially parallel" means that the angle to the axial line of the shaft is 0 degree (±10 degrees). The prepreg s1 constitutes a straight layer. Such a straight layer which reinforces the tip part may not be provided. In respects of suppressing the weight of the shaft and of enhancing the strength thereof, the straight layer which reinforces the tip part is preferably provided. The sheet s1 constitutes a tip side partial straight layer.

The prepreg s2 is provided over the full length of the shaft. The prepreg s2 constitutes a so-called bias layer. In the prepreg s2, the orientation angle of a fiber is −45 degrees (±10 degrees) to the axial line of the shaft.

Figure 2:
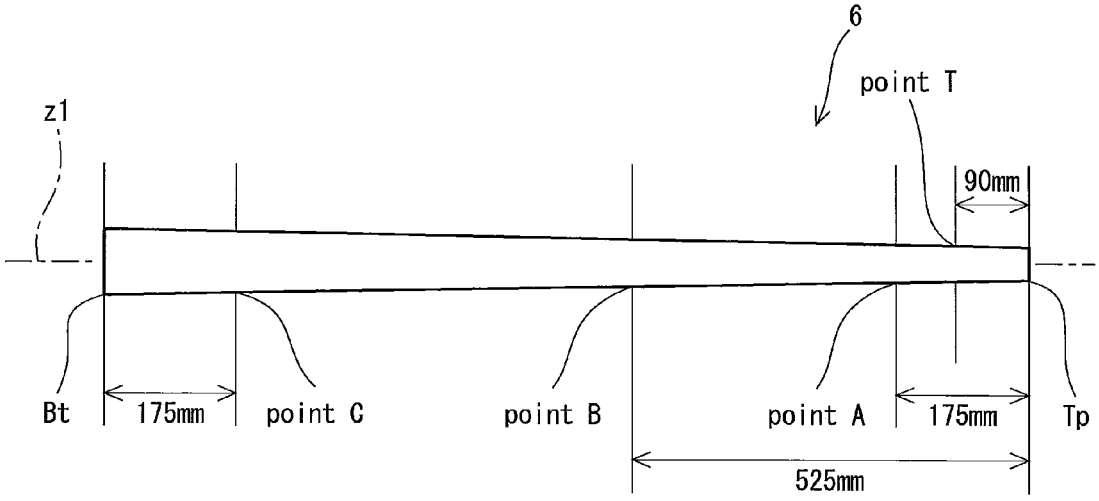
FIG. 2 is an overall view of a golf club shaft according to one embodiment of the present invention.

A prepreg s3 is also provided over the full length of the shaft. The prepreg s3 is a so-called bias layer. In the prepreg s3, the orientation angle of a fiber is substantially +45 degrees (±10 degrees) to the axial line of the shaft. The prepreg s2 and the prepreg s3 are wrapped in a state where the prepreg s2 and the prepreg s3 are overlapped with each other. When the prepreg s2 and the prepreg s3 are overlapped, the prepreg s3 is turned over from the state of FIG. 2. Thereby, the fiber orientation angles of the prepreg s2 and prepreg s3 are opposite to each other. In respects of torsional rigidity and torsional strength, the bias layer is preferably provided.

The winding number (number of layers) of the bias layer is not limited. The winding number b1 of a first bias layer (which corresponds to the prepreg s2) is not limited. When the prepreg s2 is exactly wound by a round, the winding number b1 is 1.0. When the prepreg s2 is wound by half a round, the winding number b1 is 0.5.

The winding number b2 of a second bias layer (which corresponds to the prepreg s3) of which the orientation angle of a fiber intersects with the first bias layer is not limited. Preferably, the winding number b2 is equal to the winding number b1.

When the torsional rigidity of the shaft is excessively small, the directional stability of a hitting ball and the strength of the shaft are apt to be insufficient. In respect of the torsional rigidity of the shaft, the winding number b1 and the winding number b2 are preferably equal to or greater than 1, more preferably equal to or greater than 1.5, and still more preferably equal to or greater than 2. In respect of the weight reduction of the shaft, the winding number b1 and the winding number b2 are preferably equal to or less than 4, more preferably equal to or less than 3.5, and still more preferably equal to or less than 3.

The prepreg s4 is a reinforcing layer which reinforces a tip part. In the prepreg s4, the orientation angle of a fiber is substantially parallel to the axial line of the shaft. The prepreg s4 constitutes a straight layer. The sheet s4 constitutes a tip side partial straight layer. Such a sheet s4 may not be used.

The prepreg s5 is a layer which reinforces a rear end part. In the prepreg s5, the orientation angle of a fiber is substantially parallel to the axial line of the shaft. The prepreg s5 constitutes a straight layer. The straight layer which reinforces the rear end part may not be provided. The sheet s5 constitutes a butt side partial straight layer.

A prepreg s6 is provided over the full length of the shaft. The prepreg s6 is a straight layer. In the prepreg s6, the orientation angle of a fiber is substantially parallel to the axial line of the shaft. The prepreg s6 constitutes a straight layer. In respect of the strength of the shaft, the straight layer is preferably provided over the full length of the shaft.

A prepreg s7 is provided over the full length of the shaft. The prepreg s7 is a textile prepreg. The prepreg s7 contains a textile 20 (described later). This textile 20 is a biaxial textile. The prepreg s7 is constituted by impregnating the biaxial textile 20 of a carbon fiber with a resin. The prepreg s7 has warps and wefts. The prepreg s7 constitutes a textile layer of the shaft 6. More specifically, the prepreg s7 is wound, and furthermore, a matrix resin of the prepreg s7 is cured to form the textile layer.

In the embodiment, the textile sheet s7 which forms the textile layer is a prepreg. The textile sheet may not be the prepreg. For example, the textile sheet may not contain a resin. For example, the textile sheet may be a textile itself.

A prepreg s8 is provided over the full length of the shaft. The prepreg s8 is a straight layer. In the prepreg s8, the orientation angle of a fiber is substantially parallel to the axial line of the shaft. The prepreg s8 constitutes a straight layer. In respect of suppressing the scraping of the textile layer in a polishing process, a straight layer which covers the entire textile layer may be provided on an outside in the radial direction of the textile layer. However, as described later, an outermost layer is most preferably the textile layer.

A prepreg s9 is a reinforcing layer which reinforces a tip part. In the prepreg s9, the orientation angle of a fiber is substantially parallel to the axial line of the shaft. The prepreg s9 constitutes a straight layer. Such a sheet s9 may not be used. A portion having a fixed outer diameter is formed in the tip part of the shaft by this sheet s9. The portion having the fixed outer diameter tends to be bonded to a head having a fixed inner diameter. In this respect, it is preferable that a right triangle prepreg is used as the prepreg which reinforces the tip part, and one of two sides perpendicular to each other in the right triangle is disposed on the tip side. The preferred example is the sheet s9. The sheet s9 constitutes a tip side partial straight layer.

Layers other than the straight layer and the bias layer may be provided. For example, a hoop layer may be provided. In the hoop layer, the orientation angle of a fiber to the axial line of the shaft is usually 90 degrees±10 degrees. The hoop layer is not provided in the shaft 6 of the embodiment.

As described later, the textile layer can further function as the hoop layer. In respect of weight savings, the winding number of the hoop layer which is the full length layer is preferably equal to or less than 2, more preferably equal to or less than 1, and most preferably equal to or less than 0. More specifically, it is most preferable that the hoop layer of the full length layer is not provided.

The hoop layer (partial hoop layer) may be partially provided in the longitudinal direction of the shaft. In respects of weight savings and strength, the partial hoop layer is preferably provided at a position different from that of the textile layer. In other words, it is preferable that the position of the partial hoop layer in the longitudinal direction of the shaft and the position of the textile layer in the longitudinal direction of the shaft do not overlap each other. In this respect, when the textile layer is the full length layer, it is preferable that the hoop layer does not exist.

In the manufacture of this shaft 6, a metal mandrel and the plurality of prepreg sheets are used. In this manufacture, nine prepreg sheets are first wrapped around the mandrel (not shown) in order of a prepreg s1, a prepreg s2, . . . , a prepreg s9. The prepreg shown on a higher side in FIG. 3 is laminated on the inner side.

Hereinafter, a method for manufacturing the shaft 6 will be schematically described. This manufacturing method includes the following processes (1) to (9).

(1) Cutting Process

The prepreg sheet is cut into a desired shape in the cutting process. Sheets shown in FIG. 3 are manufactured by this cutting. The sheets contain a full length sheet and a partial sheet. The full length sheet is provided over the entire axial direction of the shaft. In the embodiment of FIG. 3, the full length sheets are the sheet s2, the sheet s3, the sheet s6, the sheet s7, and the sheet s8.

In the embodiment, the sheet s7 is the full length sheet. More specifically, in the embodiment, the textile layer is provided over the entire axial direction of the shaft.

The partial sheet is partially provided in the axial direction of the shaft. In the embodiment of FIG. 3, the partial sheets are the sheet s1, the sheet s4, the sheet s5, and the sheet s9. The partial sheets include a tip sheet and a rear end sheet. The tip sheet is disposed at a position including the tip. The rear end sheet is disposed at a position including the rear end. The tip sheets are the sheet s1, the sheet s4, and the sheet s9. The rear end sheet is the sheet s5. The cutting may be performed by a cutting machine, or may be manually performed using a cutter knife or the like.

(2) Laminating Process

Sheets for the bias layer are laminated together in the laminating process. The laminating process is usually performed after the cutting process.

When the hoop layer is provided, the sheet for the hoop layer (hoop sheet) and the other sheet (the other straight sheet or the bias sheet) are laminated. This is because the single hoop sheet causes the splitting of the sheet to complicate the winding of the sheet. As described above, it is preferable that the hoop layer is not provided in the present invention. The abbreviation of the hoop layer simplifies the manufacturing process of the shaft to enhance the productivity.

(3) Winding Process

The cut sheet is wound around the mandrel in the winding process. A winding body is obtained by the winding process. This winding body is obtained by wrapping the prepreg sheet around the outside of the mandrel. The winding process may be performed by a manual operation or a machine referred to as a rolling machine or the like.

(4) Tape Wrapping Process

A tape is wrapped around the outer peripheral surface of the winding body in the tape wrapping process. This tape is also referred to as a wrapping tape. This wrapping tape is wrapped while tension is applied to the wrapping tape.

(5) Curing Process

In the curing process, the winding body after performing the tape wrapping is heated. This heating cures the matrix resin. In this curing process, the matrix resin fluidizes temporarily. This fluidization of the matrix resin can discharge air between the sheets or in the sheet. The tension (tightening force) of the wrapping tape accelerates this discharge of the air. This curing provides a cured laminate.

(6) Process of Extracting Mandrel and Process of Removing Wrapping Tape

The process of extracting the mandrel and the process of removing the wrapping tape are performed. The order of the both processes is not limited. However, the process of removing the wrapping tape is preferably performed after the process of extracting the mandrel in respect of enhancing the efficiency of the process of removing the wrapping tape.

(7) Process of Cutting Both Ends

The both end parts of the cured laminate are cut in this process. This cutting forms the tip Tp and the butt Bt of the shaft. This cutting flattens the end face of the tip Tp and the end face of the butt Bt.

(8) Polishing Process

The surface of the cured laminate is polished in this process. This polishing is also referred to as surface polishing. Spiral unevenness left behind as the trace of the wrapping tape exists on the surface of the cured laminate. The polishing extinguishes the unevenness as the trace of the wrapping tape to flatten the surface of the cured laminate.

(9) Coating Process

The cured laminate is subjected to coating after the polishing process.

As described above, in the embodiment, the textile sheet s7 is used. This textile sheet s7 contains the biaxial textile.

Figure 4:
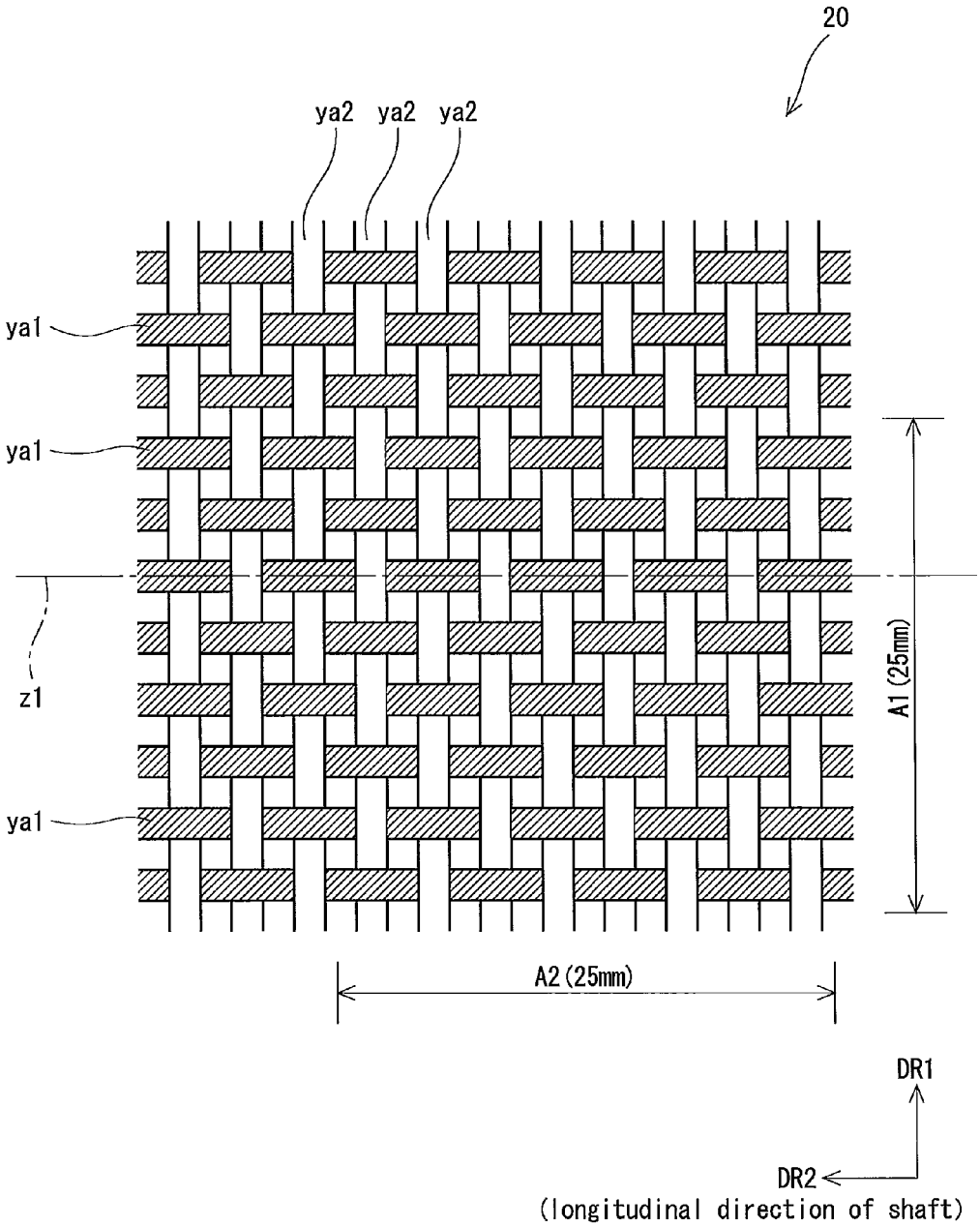
FIG. 4 is a diagram showing one example of a textile.

FIG. 4 shows the textile 20 contained in the textile layer (sheet s7). The textile 20 is the biaxial textile. This textile 20 includes warps ya1 and wefts ya2.

This textile 20 is plain woven. This weave is not limited. As the weave of the warp ya1 and the weft ya2, twill weave and satin weave in addition to plain weave are exemplified.

In the present application, one oriented substantially parallel to an axial direction z1 of the shaft is referred to as the warp ya1. In the present application, one oriented substantially rectangularly to the axial direction of the shaft is referred to as the weft ya2. The warp ya1 and the weft ya2 are substantially orthogonal to each other.

In respect of figure easily understood, a clearance is formed between the warps ya1, and a clearance is formed between the wefts ya2 in FIG. 4. These clearances may not exist. The warps ya1 are shown by hatching in order to make the figure understandable.

In the shaft 6, the warps ya1 are oriented substantially parallel to the axial direction z1 of the shaft. "Substantially parallel" means that the orientation angle of the warp ya1 to the axial direction z1 of the shaft is 0 degree ±10 degrees. The axial direction z1 of the shaft is shown by a one-dashed chain line in FIG. 4.

In the shaft 6, the wefts ya2 are oriented substantially perpendicularly to the axial direction z1 of the shaft. "Substantially perpendicularly" means that the orientation angle of the weft ya2 to the axial direction z1 of the shaft is 90 degrees ±10 degrees. In other words, the wefts ya2 are oriented substantially parallel to the circumferential direction of the shaft.

The warp ya1 is made of a carbon fiber. As the number of filaments of the warp ya1, 1K, 2K, 3K, 6K, and 12K are exemplified. 1K means that the number of filaments is 1,000. Therefore, for example, 2K means that the number of filaments is 2,000.

The weft ya2 is made of a carbon fiber. As the number of filaments of the weft ya2, 1K, 2K, 3K, 6K, and 12K are exemplified.

The number of filaments of the warp ya1 may be the same as that of the weft ya2. The number of filaments of the warp ya1 may be different from that of the weft ya2.

In the embodiment, the fiber of the warp ya1 is different from that of the weft ya2. Preferably, this difference is physical properties and/or the type of the fiber. Examples of the physical properties include a tensile elastic modulus and a tensile strength. In the embodiment, different fibers are respectively used for the warp ya1 and the weft ya2, and the warps ya1 and the wefts ya2 are appropriately oriented.

In the preferred embodiment, when the tensile elastic modulus of the warp ya1 is defined as ET (tf/mm$^2$) and the tensile elastic modulus of the weft ya2 is defined as EY (tf/mm$^2$), the tensile elastic modulus ET is smaller than the tensile elastic modulus EY.

The tensile elastic modulus ET and the tensile elastic modulus EY are measured in accordance with "JIS R 7601: 1986".

In another preferred embodiment, when the tensile strength of the warp ya1 is defined as ST (kgf/mm$^2$) and the tensile strength of the weft ya2 is defined as SY (kgf/mm$^2$), the tensile strength ST is greater than the tensile strength SY.

The tensile strength ST and the tensile strength SY are measured in accordance with "JIS R 7601: 1986".

In still another preferred embodiment, the type of the fiber of the warp ya1 is different from that of the weft ya2. More preferably, the warp ya1 is made of a PAN carbon fiber, and the warp ya1 is a pitch carbon fiber.

The PAN carbon fiber is derived from polyacrylonitrile. The PAN carbon fiber is obtained by firing polyacrylonitrile.

The pitch carbon fiber is derived from pitch. The pitch carbon fiber is obtained by spinning and heat treating the pitch. The typical example of the pitch is petroleum pitch. The petroleum pitch is a residue when distilling crude oil at high temperature. Examples of the pitch carbon fiber include an isotropic pitch carbon fiber and an anisotropic pitch carbon fiber. The anisotropic pitch carbon fiber is also referred to a mesophase pitch carbon fiber. In respect of tending to obtain a high elastic modulus, it is preferable that the pitch carbon fiber is the mesophase pitch carbon fiber.

The pitch carbon fiber is believed to have low adhesion to the matrix resin as compared to the PAN carbon fiber. This low adhesion may cause the reduction of the strength of the shaft when a prepreg containing only the pitch carbon fiber is used. This drawback of the pitch carbon fiber can be overcome by using a textile obtained by weaving the PAN carbon fiber and the pitch carbon fiber. By using a textile obtained by weaving the pitch carbon fiber having poor adhesion and the PAN carbon fiber having excellent adhesion, the low adhesion of the pitch carbon fiber is compensated by the PAN carbon fiber.

On the other hand, the pitch carbon fiber tends to realize a high elastic modulus. Particularly, in the mesophase pitch carbon fiber, a high elastic modulus tends to be obtained. The pitch carbon fiber is oriented substantially perpendicularly to the axial direction z1 of the shaft to effectively suppress a crushing deformation. This suppression of the crushing deformation can enhance the strength of the shaft effectively. In addition, the strength of the shaft to a bending deformation tends to be enhanced by orienting the PAN carbon fiber substantially parallel to the axial direction z1 of the shaft. The strength of the shaft can be effectively enhanced by appropriately using the textile of the pitch carbon fiber and the PAN carbon fiber.

When the PAN carbon fiber and the pitch carbon fiber having the same tensile elastic modulus are compared, and the tensile elastic modulus is generally equal to or less than 50 (tf/mm$^2$), the PAN carbon fiber is more inexpensive than the pitch carbon fiber. Therefore, when both the tensile elastic modulus ET and the tensile elastic modulus EY are equal to or less than 50 (tf/mm$^2$), it is preferable that both the warp ya1 and the weft ya2 are the PAN carbon fiber in respect of reducing material costs. When the tensile elastic modulus exceeds 50 (tf/mm$^2$), the pitch carbon fiber is more inexpensive than the PAN carbon fiber. Therefore, when the tensile elastic modulus ET is equal to or less than 50 (tf/mm$^2$), and the tensile elastic modulus EY exceeds 50 (tf/mm$^2$), it is preferable that the PAN carbon fiber is used for the warp ya1 and the pitch carbon fiber is used for the weft ya2 in respect of reducing the material costs.

The crushing deformation of the shaft interlocks with the bending deformation. In a light-weight shaft that is particularly thin, the crushing deformation is apt to take place simultaneously with the bending deformation. An excessive crushing deformation may cause breakage of the shaft. The excessive crushing deformation may reduce a bending strength.

The carbon fiber tends to be stretched in the longitudinal direction of the shaft by reducing the tensile elastic modulus ET of the warp ya1. This ease of stretching tends to cause the enhancement of the bending strength of the shaft. The crushing deformation can be effectively suppressed by increasing the tensile elastic modulus EY of the weft ya2. Crushing rigidity can be enhanced and the bending strength can be effectively enhanced by making the tensile elastic modulus ET (tf/mm$^2$) smaller than the tensile elastic modulus EY (tf/mm$^2$).

Since the warp ya1 and the weft ya2 are woven, the displacement of the warp ya1 is suppressed by the weft ya2, and the displacement of the wefts ya2 is suppressed by the warp ya1. An effect of the warp ya1 and an effect of the weft ya2 can be mutually and synergistically enhanced in the textile layer.

As described above, the weave texture of the textile 20 is not limited. In respect of enhancing the restriction of the weft ya2 by the warp ya1 and the restriction of the warp ya1 by the weft ya2 with a satisfactory balance, the weave texture of the textile 20 is preferably plain weave, twill weave and satin weave. In respect of equalizing the weaving manner of the warp ya1 and the weft ya2 to tend to have an effect on both flexural rigidity and crushing rigidity, the plain weave is particularly preferable.

The position of the textile layer in the radial direction of the shaft is not limited. As this position, an outermost position, an innermost position, and an intermediate position are exemplified. The intermediate position means that the textile layer is neither an outermost layer nor an innermost layer. In the case of the outermost position, the textile layer constitutes the outermost layer. In the case of the innermost position, the textile layer constitutes the innermost layer.

Generally, it is known that a bending moment is proportional to the cube of a radius. In respect of enhancing the effect of the textile layer, the textile layer is preferably provided on an outside in the radial direction of the shaft. In this respect, the textile layer is preferably provided at the intermediate position or the outermost position, and more preferably provided at the outermost position.

In respect of suppressing the excessive reduction of the flexural rigidity of the shaft, the tensile elastic modulus ET of the warp ya1 is preferably equal to or greater than 10 (tf/mm$^2$), more preferably equal to or greater than 15 (tf/mm$^2$), and still more preferably equal to or greater than 20 (tf/mm$^2$). In respect of enhancing the bending strength of the shaft, the tensile elastic modulus ET of the warp ya1 is preferably equal to or less than 50 (tf/mm$^2$), more preferably equal to or less than 40 (tf/mm$^2$), and still more preferably equal to or less than 30 (tf/mm$^2$).

In respect of suppressing the crushing deformation, the tensile elastic modulus EY of the weft ya2 is preferably equal to or greater than 20 (tf/mm$^2$), more preferably equal to or greater than 30 (tf/mm$^2$), and still more preferably equal to or greater than 35 (tf/mm$^2$). When the tensile elastic modulus EY is excessively great, crushing destruction is apt to take place. When the tensile elastic modulus EY is excessively great, the wrapped sheet is apt to be curled up. More specifically, when the tensile elastic modulus EY is excessively great, it is difficult to wind the textile sheet. In these respects, the tensile elastic modulus EY is preferably equal to or less than 70 (tf/mm$^2$), more preferably equal to or less than 50 (tf/mm$^2$), and still more preferably equal to or less than 40 (tf/mm$^2$).

A ratio (EY/ET) is not limited. In respect of enhancing the effect caused by making the tensile elastic modulus EY greater than the tensile elastic modulus ET, the ratio (EY/ET) is preferably equal to or greater than 1.1, more preferably equal to or greater than 1.3, and still more preferably equal to or greater than 1.5. When the tensile elastic modulus ET is excessively small, the flexural rigidity of the shaft is insufficient. When the tensile elastic modulus EY is excessively great, the tensile strength of the weft ya2 may be excessively small to reduce the strength of the shaft instead. In these respects, the ratio (EY/ET) is preferably equal to or less than 4, more preferably equal to or less than 3, and still more preferably equal to or less than 2.

The crushing deformation can be suppressed and the bending strength of the shaft can be effectively enhanced by making the tensile strength ST (kgf/mm$^2$) greater than the tensile strength SY (kgf/mm$^2$).

In respect of enhancing the bending strength of the shaft, the tensile strength ST of the warp ya1 is preferably equal to or greater than 350 (kgf/mm$^2$), more preferably equal to or greater than 400 (kgf/mm$^2$), still more preferably equal to or greater than 450 (kgf/mm$^2$), and particularly preferably equal to or greater than 480 (kgf/mm$^2$). In respects of securing the flexural rigidity (flex) required for the shaft while suppressing the weight of the shaft, and of the material costs, the tensile strength ST is preferably equal to or less than 650 (kgf/mm$^2$), more preferably equal to or less than 600 (kgf/mm$^2$), and still more preferably equal to or less than 550 (kgf/mm$^2$).

In respect of enhancing the strength to the crushing deformation, the tensile strength SY of the weft ya2 is preferably equal to or greater than 300 (kgf/mm$^2$), more preferably equal to or greater than 350 (kgf/mm$^2$), and still more preferably equal to or greater than 400 (kgf/mm$^2$). In respects of greatening the tensile elastic modulus EY to enhance the crushing deformation, and of the material costs, the tensile strength SY is equal to or less than 600 (kgf/mm$^2$), more preferably equal to or less than 500 (kgf/mm$^2$), and still more preferably equal to or less than 470 (kgf/mm$^2$).

A ratio (SY/ST) is not limited. When the tensile strength SY is excessively small, the bending strength of the shaft may be reduced. When the tensile strength ST is excessively great, the tensile elastic modulus ET of the warp ya1 may be excessively small to cause insufficient shaft rigidity. In these respects, the ratio (SY/ST) is preferably equal to or greater than 0.5, more preferably equal to or greater than 0.7, and still more preferably equal to or greater than 0.8. In respect of enhancing the effect caused by making the tensile strength ST greater than the tensile strength SY, the ratio (SY/ST) is preferably equal to or less than 0.99, more preferably equal to or less than 0.95, and still more preferably equal to or less than 0.93.

When the shaft is bent and deformed, great tensile stress acts on the warp ya1. Therefore, the strength of the shaft can be effectively enhanced by greatening the tensile strength of the warp ya1. On the other hand, the tensile stress acts on the weft ya2 by the crushing deformation. Therefore, it is effective to suppress the crushing deformation in order to enhance the strength of the shaft to crushing stress, and it is effective to enhance the tensile elastic modulus EY.

One warp ya1 is a bundle of filaments of the carbon fiber. The number TK of the filaments contained in one warp ya1 is not limited. When the number TK of the filaments is excessively small, the winding number of the sheet may be excessively great to reduce the productivity of the winding process.

In this respect, the number TK of the filaments is preferably equal to or greater than 1,000 (1K), more preferably equal to or greater than 1,200, and still more preferably equal to or greater than 1,500. When the number TK of the filaments is excessively great, a placing number TH may be excessively small to cause an excessively small fiber density. The excessively small fiber density may reduce the strength of the shaft. In respect of the fiber density, the number TK of the filaments is preferably equal to or less than 6,000, more preferably equal to or less than 4,000, and still more preferably equal to or less than 3,000.

One weft ya2 is a bundle of filaments of the carbon fiber. The number YK of the filaments contained in one weft ya2 is not limited. When the number YK of the filaments is excessively small, the winding number of the sheet may be excessively great to reduce the productivity of the winding process. In this respect, the number YK of the filaments is preferably equal to or greater than 1,000 (1K), more preferably equal to or greater than 1,200, and still more preferably equal to or greater than 1,500. When the number YK of the filaments is excessively great, a placing number YH may be excessively small to cause an excessively small fiber density. The excessively small fiber density may reduce the strength of the shaft. In respect of the fiber density, the number YK of the filaments is preferably equal to or less than 6,000, more preferably equal to or less than 4,000, and still more preferably equal to or less than 3,000.

A ratio (TK/YK) is not limited. When the ratio (TK/YK) is small, the excessively great fibers are apt to be substantially orthogonally to the axial direction z1 of the shaft, and the excessively small fibers are apt to be substantially parallel to the axial direction z1 of the shaft. In this respect, the ratio (TK/YK) is preferably equal to or greater than 1, more preferably equal to or greater than 1.2, and still more preferably equal to or greater than 1.5. In respect of suppressing the crushing deformation, the ratio (TK/YK) is preferably equal to or less than 4, more preferably equal to or less than 3.5, and still more preferably equal to or less than 3.

The placing number TH (warps/25 mm) of the warps ya1 is not limited. When a weave texture is excessively coarse, a binding force to the weft ya2 is reduced. In respect of enhancing the binding force to the weft ya2, the placing number TH is preferably equal to or greater than 10 (warps/25 mm), more preferably equal to or greater than 12.5 (warps/25 mm), and still more preferably equal to or greater than 15 (warps/25 mm). When the weave texture is excessively minute, it is difficult to produce the textile, or the cost of the textile is increased. In these respects, the placing number TH is equal to or less than 40 (warps/25 mm), preferably equal to or less than 37.5 (warps/25 mm), and more preferably equal to or less than 35 (warps/25 mm).

A direction perpendicular to the extending direction of the warp ya1 is defined as DR1. At this time, the placing number TH is the number of the warps ya1 which exist in a range A1 (see FIG. 4) having a width of 25 mm. The width of the range A1 is measured along the direction DR1.

The placing number YH (wefts/25 mm) of the wefts ya2 is not limited. When a weave texture is excessively coarse, a binding force to the warp ya1 is reduced. In respect of enhancing the binding force to the warp ya1, the placing number YH is preferably equal to or greater than 10 (wefts/25 mm), more preferably equal to or greater than 12.5 (wefts/25 mm), and still more preferably equal to or greater than 15 (wefts/25 mm). When the weave texture is excessively minute, it is difficult to produce the textile, or the cost of the textile is increased. In these respects, the placing number YH is equal to or less than 40 (wefts/25 mm), preferably equal to or less than 37.5 (wefts/25 mm), and more preferably equal to or less than 35 (wefts/25 mm).

A direction perpendicular to the extending direction of the weft ya2 is defined as DR2. At this time, the placing number YH is the number of the wefts ya2 which exist in a range A2 (see FIG. 4) having a width of 25 mm. The width of the range A2 is measured along the direction DR2.

A ratio (TH/YH) is not limited. When the wefts ya2 are excessively great, the flexural rigidity caused by the warps ya1 may be insufficient. In this respect, the ratio (TH/YH) is preferably equal to or greater than 1, more preferably equal to or greater than 1.2, and still more preferably equal to or greater than 1.5. In respect of enhancing the crushing rigidity caused by the wefts ya2, the ratio (TH/YH) is preferably equal to or less than 4, more preferably equal to or less than 3.5, and still more preferably equal to or less than 3.

A thickness Rt of the textile layer is not limited. In respect of facilitating the manufacture of the textile, the thickness Rt of the textile layer is preferably equal to or greater than 0.05 (mm), more preferably equal to or greater than 0.08 (mm), and still more preferably equal to or greater than 0.1 (mm). In respect of enhancing the fiber density to enhance the strength of the shaft, the thickness Rt of the textile layer is preferably equal to or less than 0.4 (mm), more preferably equal to or less than 0.35 (mm), and still more preferably equal to or less than 0.3 (mm). The thickness Rt of the textile layer is substantially equal to the thickness of the textile sheet (textile prepreg) to be used. The thickness Rt of the textile layer can be measured from the cross section of the shaft.

A resin content rate Rw of the textile layer is not limited. In respect of enhancing a tacky property of the prepreg to suppress unwinding in the winding process, the resin content rate Rw is preferably equal to or greater than 20% by weight, more preferably equal to or greater than 22% by weight, and still more preferably equal to or greater than 24% by weight. In respect of suppressing the excessive increase of the weight of the shaft, the resin content rate Rw is preferably equal to or less than 40% by weight, more preferably equal to or less than 38% by weight, and still more preferably equal to or less than 30% by weight.

The textile layer may be provided over the entire longitudinal direction of the shaft. In other words, the textile layer may be the full length layer. In the embodiment of FIG. 3 described above, the textile layer is the full length layer. When the textile layer is the full length layer, this textile layer is also referred to a full length textile layer.

The winding number of the full length textile layer is defined as nW. The winding number of a full length straight layer is defined as nS. The winding number of a full length hoop layer is defined as nF. In respect of obtaining a shaft having a light weight and a high strength, nW is preferably equal to or greater than nS. nW is more preferably greater than nS. In respect of obtaining a shaft having a light weight and a high strength, nW is preferably greater than nF.

The textile layer may be partially provided in the longitudinal direction of the shaft. In other words, the textile layer may be a partial layer. The arrangement of this partial textile layer is not limited. The partial textile layer may be provided on the tip Tp side, or may be provided on the butt Bt side. The partial textile layer provided on the tip Tp side is a textile layer which exists in a range including the tip Tp, and is also referred to a tip side partial textile layer. The partial textile layer provided on the butt Bt side is a textile layer which exists in a range including the butt Bt, and is also referred to a butt side partial textile layer. The partial layer may be disposed at a position which does not include the tip Tp and the butt Bt. This partial textile layer is also referred to an intermediate portion textile layer.

The partial textile layer is obtained by using the textile prepreg as the partial sheet.

In the shaft having the full length textile layer, the effect of the textile layer can be obtained over the full length of the shaft. Therefore, the full length textile layer is effective for a thin shaft having a light weight. In this respect, in the shaft having the full length textile layer, the maximum value Tmax of the thickness of the shaft is preferably equal to or less than 4.0 (mm), more preferably equal to or less than 3.5 (mm), and still more preferably equal to or less than 3.0 (mm). In respect of the strength of the shaft, the minimum value Tmin of the thickness of the shaft is preferably equal to or greater than 0.3 (mm), and more preferably equal to or greater than 0.5 (mm). The maximum value Tmax is a thickness of the thickest portion of the entire shaft. The minimum value Tmin is a thickness of the thinnest portion of the entire shaft.

The provision of the tip side partial textile layer is effective for reinforcing a portion closer to the tip. When the strength of the portion (for example, point T and point A) closer to the tip Tp is apt to be insufficient, a tip side partial reinforcing layer is preferably provided. In this case, the strength of the shaft can be effectively enhanced while the increase of the weight of the shaft can be suppressed. The point T is a position separated by 90 mm from the tip Tp. The point A is a position separated by 175 mm from the tip Tp (see FIG. 2).

The winding number of the tip side partial textile layer is defined as nTW. The winding number of the tip side partial straight layer is defined as nTS. The winding number of a tip side partial hoop layer is defined as nTF. In respect of obtaining a shaft having a light weight and a high strength, nTW is preferably equal to or greater than nTS, and nTW is more preferably greater than nTS. In respect of obtaining a shaft having a light weight and a high strength, nTS is preferably 0. In respect of obtaining a shaft having a light weight and a high strength, nTW is preferably equal to or greater than nTF, and nTW is more preferably greater than nTF. In respect of obtaining a shaft having a light weight and a high strength, nTF is preferably 0.

The provision of the butt side partial textile layer is effective for reinforcing a portion closer to the butt. When the strength of the portion (for example, the vicinity of point C) closer to the butt Bt is apt to be insufficient, a butt side partial reinforcing layer is preferably provided. In this case, the strength of the shaft can be effectively enhanced while the increase of the weight of the shaft can be suppressed. The point C is a position separated by 175 mm from the butt Bt (see FIG. 2).

The winding number of the butt side partial textile layer is defined as nBW. The winding number of the butt side partial straight layer is defined as nBS. The winding number of the butt side partial hoop layer is defined as nBF. In respect of obtaining a shaft having a light weight and a high strength, nBW is preferably equal to or greater than nBS, and nBW is more preferably greater than nBS. In respect of obtaining a shaft having a light weight and a high strength, nBS is preferably 0. In respect of obtaining a shaft having a light weight and a high strength, nBW is preferably equal to or greater than nBF, and nBW is more preferably greater than nBF. In respect of obtaining a shaft having a light weight and a high strength, nBF is preferably 0.

The total thickness of the textile layer is defined as TW1, and the total thickness of the hoop layer is defined as TF1. In respect of obtaining a shaft having a light weight and a high strength, in all positions in the longitudinal direction of the shaft and all positions in the circumferential direction of the shaft, the total thickness TW1 is preferably equal to or greater than the total thickness TF1, and the total thickness TW1 is more preferably greater than the total thickness TF1.

The total thickness TW1 and the total thickness TF1 are respectively determined in the longitudinal direction of the shaft, and are respectively determined in the circumferential direction of the shaft.

EXAMPLES

Hereinafter, the effects of the present invention will be clarified by example. However, the present invention should not be interpreted in a limited way based on the description of the example.

Figure 5:
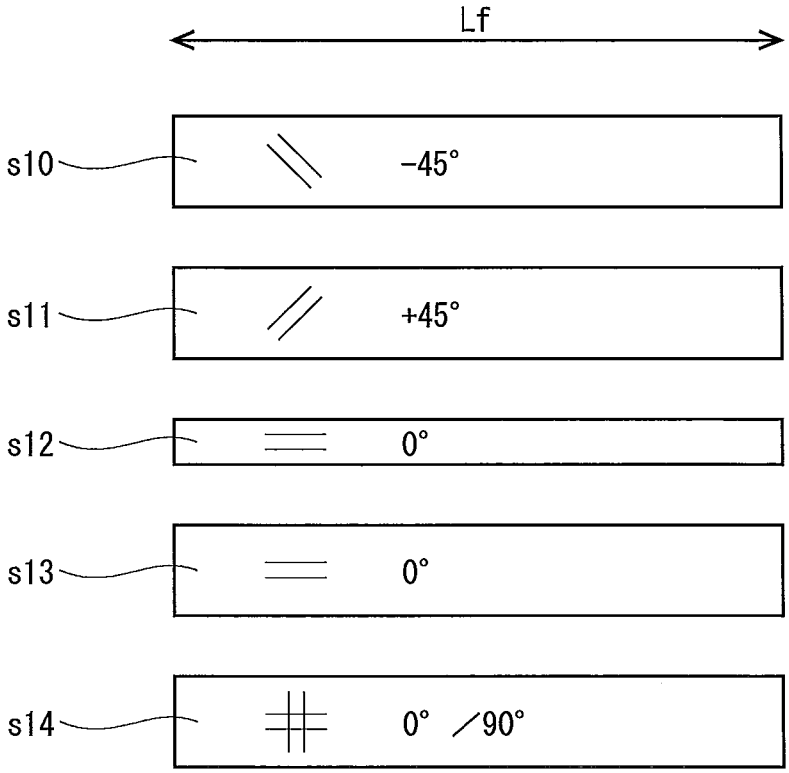
FIG. 5 is a development view of a shaft of example and comparative examples.

A tubular shaft was produced, and the effects of the present invention were verified. In respect of reducing a wrinkle of a sheet and an error of orientation of a fiber to enhance experimental accuracy, the inner and outer diameters of the shaft were fixed. FIG. 5 is a development view of prepregs used for a shaft of the example. A sheet s10 and a sheet s11 are bias sheets. A sheet s12 and a sheet s13 are straight sheets. A sheet s14 is a textile sheet. A cylindrical mandrel having a fixed outer diameter of 13.8 (mm) was used. In a winding process, the sheet formed by sticking the sheet s10 and the sheet s11 to each other, the sheet s12, the sheet s13, and the sheet s14 were wound around this mandrel in this order. A shaft of example 1 was obtained according to the manufacturing method described above. However, in respect of eliminating the influences of polishing and coating to enhance the experimental accuracy, a polishing process and a coating process were not performed. The shaft had a fixed thickness of 1.0 (mm).

Product names of sheets used in the example are described in Table 1. The sheet s10, the sheet s11, the sheet s12, and the sheet s13 are prepregs manufactured by MITSUBISHI RAYON CO., LTD. The full length Lf (after cutting both ends) of the shaft was set to 500 (mm).

As the textile sheet s14, a prepreg obtained by impregnating a textile with an epoxy resin (#2500 resin system, manufactured by TORAY INDUSTORIES, INC.) was used. The thickness of this prepreg was 0.20 (mm) and the thickness Rt of a textile layer was also 0.20 (mm). The resin content rate of the textile sheet s14 was set to 40% by weight. Therefore, the resin content rate Rw of the textile layer is also 40% by weight.

"T700S" (product name, manufactured by TORAY INDUSTORIES, INC.) was used for warp ya1 of this textile. "M40S" (product name, manufactured by TORAY INDUSTORIES, INC.) was used for weft ya2 of this textile. In this textile, the warps ya1 and the wefts ya2 are plain woven.

A tensile elastic modulus (tensile elastic modulus ET) of "700S" used for the warp ya1 was 23.5 (tf/mm$^2$). A tensile strength (tensile strength ST) thereof was 500 (kgf/mm$^2$). A number TK of filaments was 3,000 (3K). A placing number TH of the warps ya1 in the textile was set to 17.5 (warps/25 mm). "T700S" is a PAN carbon fiber.

A tensile elastic modulus (tensile elastic modulus EY) of "M40S" used for the weft ya2 was 38.5 (tf/mm$^2$). A tensile strength (tensile strength SY) thereof was 460 (kgf/mm$^2$). The number YK of filaments was 3,000 (3K). A placing number YH of the wefts ya2 in the textile was set to 17.5 (wefts/25 mm). "M40S" is a PAN carbon fiber.

Therefore, a ratio (TK/YK) in the textile is 1 and a ratio (TH/YH) is 1. Specifications of this example are shown in Table 1, and results of evaluation thereof are shown in Table 2.

Comparative Example 1

A shaft of comparative example 1 was obtained in the same manner as in the example 1 except that "T700S" described above was used for the warp ya1 and the weft ya2. Specifications of this comparative example 1 are shown in Table 1, and results of evaluation thereof are shown in Table 2.

Comparative Example 2

A shaft of comparative example 2 was obtained in the same manner as in the example 1 except that "M40S" described above was used for the warp ya1 and the weft ya2. Specifications of this comparative example 2 are shown in Table 1, and results of evaluation thereof are shown in Table 2.

[Measurement of Three-Point Bending Strength]

Figure 6:
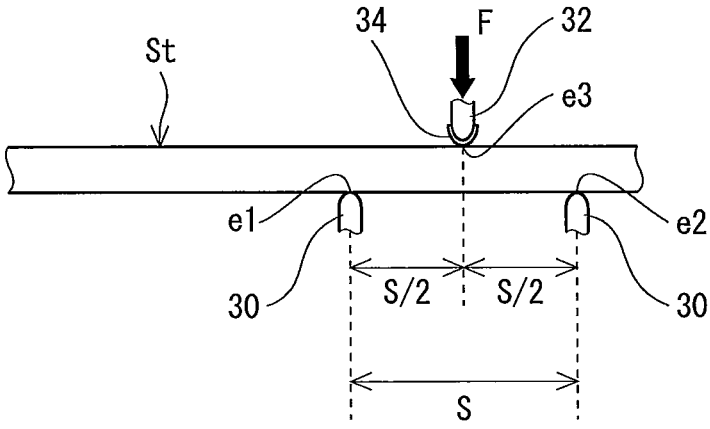
FIG. 6 is a diagram showing a method for measuring a three-point bending strength.

A measuring method according to an SG type three-point bending strength test was employed. This measuring method is a test set by Consumer Product Safety Association. FIG. 6 shows the measuring method of this three-point bending strength test. As shown in FIG. 6, a load F was applied downward from above at a load point e3 while a shaft St was supported from below at two supporting points e1 and e2. A distance between the supporting points e1 and e2 (a span S) was set to 300 mm. The load point e3 is placed at a position bisecting the supporting points e1 and e2. The load point e3 is a measuring point. The measuring point was set to a central position in the longitudinal direction of the shaft St. More specifically, the measuring point was placed apart from a tip Tp and a butt Bt by 250 (mm). An indenter 32 was moved downward at a rate of 20 mm/min, and a value (peak value) of a load F when the shaft St was broken was measured. The results are shown in the following Table 2.

A roundness is applied to the upper ends of supports 30 constituting the supporting points e1 and e2. The curvature radius of this roundness was set to 12.5 (mm) in a cross section along the axial line of the shaft St. A roundness is applied to the lower end of the indenter 32 constituting the load point e3. The curvature radius of this roundness was set to 75 (mm) in the cross section along the axial line of the shaft St. A silicon rubber 34 having a thickness of 2.0 (mm) was provided between the indenter 32 and the shaft St.

[Measurement of Crushing Strength]

Figure 7:
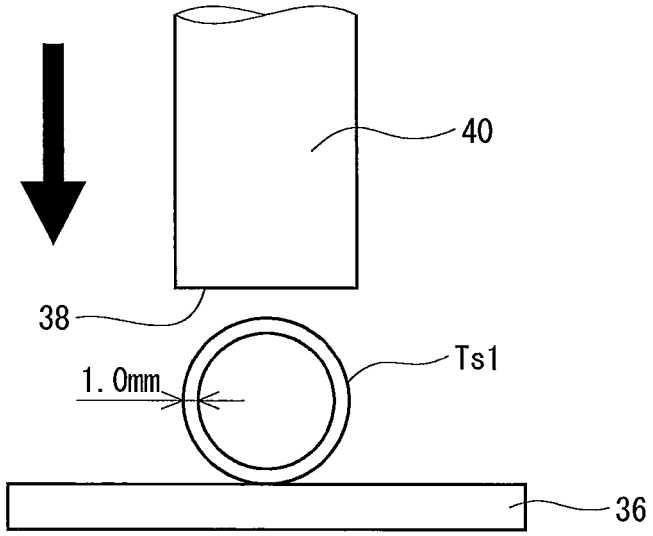
FIG. 7 is a diagram showing a method for measuring a crushing strength.

FIG. 7 is a diagram showing a method for measuring a crushing strength. A shaft was cut to produce a test sample Ts1 having a length of 10 (mm) along the longitudinal direction of the shaft. This test sample Ts1 is a cylindrical body having an inner diameter of 13.8 (mm) and an axial directional length of 10 (mm). This test sample Ts1 was placed on a metal flat plate 36. The test sample Ts1 was pressed from above by a metal indenter 40 having a planar lower end face 38 to measure a load (peak value) when the test sample Ts1 was broken. The results are shown in the following Table 2.

TABLE 1

Specifications of Example and Comparative Examples

| | Example | | | | | Comparative Example 1 | | | | | Comparative Example 2 | | | | |
|---|---|---|---|---|---|---|---|---|---|---|---|---|---|---|---|
| Sheet | Prepreg Type | Orientation Angle of Fiber | (TK/YK) | (TH/YH) | Winding Number | Prepreg Type | Orientation Angle of Fiber | (TK/YK) | (TH/YH) | Winding Number | Prepreg Type | Orientation Angle of Fiber | (TK/YK) | (TH/YH) | Winding Number |
| s10 | MR350C-125S | −45° | — | — | 2 | MR350C-125S | 45° | — | — | 2 | MR350C-125S | 45° | — | — | 2 |
| s11 | MR350C-125S | 45° | — | — | 2 | MR350C-125S | 45° | — | — | 2 | MR350C-125S | 45° | — | — | 2 |
| s12 | MR350C-100S | 0° | — | — | 1 | MR350C-100S | 0° | — | — | 1 | MR350C-100S | 0° | — | — | 1 |
| s13 | TR350C-150S | 0° | — | — | 2 | TR350C-150S | 0° | — | — | 2 | TR350C-150S | 0° | — | — | 2 |
| s14 | T700S/M40S | 0°/90° | 1.0 | 1.0 | 2 | T700S/T700S | 0°/90° | 1.0 | 1.0 | 2 | M40S/M40S | 0°/90° | 1.0 | 1.0 | 2 |

TABLE 2

Specifications and Results of Evaluation of Example and Comparative Examples

| | Constitution of Textile | | Evaluation of Strength | |
|---|---|---|---|---|
| | Warp | Weft | Three-Point Bending Strength (kgf) | Crushing Strength (kgf) |
| Example | T700S | M40S | 225 | 46 |
| Comparative Example 1 | T700S | T700S | 211 | 31 |
| Comparative Example 2 | M40S | M40S | 145 | 48 |

As shown in Table 2, the example has higher evaluation than those of the comparative examples. Advantages of the present invention are obvious indicated by the results of evaluation.

The present invention described above is applicable to all types of golf club shafts.

The description hereinabove is merely an illustrative example, and various modifications can be made in the scope not to depart from the principles of the present invention.

What is claimed is:

1. A golf club shaft comprising a textile layer, wherein the textile layer has a biaxial textile including warps of a carbon fiber and wefts of a carbon fiber;

the warp is oriented substantially parallel to an axial direction of the shaft;

the weft is oriented substantially perpendicularly to the axial direction of the shaft; and when a tensile elastic modulus of the warp is defined as ET ($tf/mm^2$) and a tensile elastic modulus of the weft is defined as EY ($tf/mm^2$), the tensile elastic modulus ET is smaller than the tensile elastic modulus EY, wherein a ratio (EY/ET) is 1.1 or greater and 4 or less.

2. The golf club shaft according to claim 1, wherein the warp is a PAN carbon fiber and the weft is a pitch carbon fiber.

3. The golf club shaft according to claim 2, wherein a ratio (EY/ET) is 1.1 or greater and 4 or less.

4. The golf club shaft according to claim 1, wherein when a tensile strength of the warp is defined as ST ($kgf/mm^2$) and a tensile strength of the weft is defined as SY ($kgf/mm^2$), the tensile strength ST is greater than the tensile strength SY.

5. The golf club shaft according to claim 4, wherein a ratio (EY/ET) is 1.1 or greater and 4 or less.

6. The golf club shaft according to claim 4, wherein a ratio (SY/ST) is 0.5 or greater and 0.99 or less.

7. The golf club shaft according to claim 1, wherein when a placing number of the warps is defined as TH (warps/25 mm), and a placing number of the wefts is defined as YH (wefts/25 mm), a ratio (TH/YH) is 1 or greater and 4 or less.

8. A golf club comprising:

the shaft according to claim 1;

a head; and a grip.

9. A golf club shaft comprising at least one textile layer, wherein the textile layer has a biaxial textile including warps of a carbon fiber and wefts of a carbon fiber;

the warp is oriented substantially parallel to an axial direction of the shaft;

the weft is oriented substantially perpendicularly to the axial direction of the shaft; and the warp is a PAN carbon fiber and the weft is a pitch carbon fiber.

10. The golf club shaft according to claim 9, wherein when a placing number of the warps is defined as TH (warps/25 mm), and a placing number of the wefts is defined as YH (wefts/25 mm), a ratio (TH/YH) is 1 or greater and 4 or less.

11. A golf club shaft comprising at least one textile layer, wherein the textile layer has a biaxial textile including warps of a carbon fiber and wefts of a carbon fiber;

the warp is oriented substantially parallel to an axial direction of the shaft;

the weft is oriented substantially perpendicularly to the axial direction of the shaft; and when a tensile strength of the warp is defined as ST ($kgf/mm^2$) and a tensile strength of the weft is defined as SY ($kgf/mm^2$), the tensile strength ST is greater than the tensile strength SY, wherein a ratio (SY/ST) is 0.5 or greater and 0.99 or less.

12. The golf club shaft according to claim 11, wherein when a placing number of the warps is defined as TH (warps/25 mm), and a placing number of the wefts is defined as YH (wefts/25 mm), a ratio (TH/YH) is 1 or greater and 4 or less.

* * * * *